US010083708B2

(12) United States Patent
Atti et al.

(10) Patent No.: US 10,083,708 B2
(45) Date of Patent: Sep. 25, 2018

(54) ESTIMATION OF MIXING FACTORS TO GENERATE HIGH-BAND EXCITATION SIGNAL

(71) Applicant: QUALCOMM Incorporated, San Diego, CA (US)

(72) Inventors: Venkatraman S. Atti, San Diego, CA (US); Venkatesh Krishnan, San Diego, CA (US)

(73) Assignee: QUALCOMM Incorporated, San Diego, CA (US)

( * ) Notice: Subject to any disclaimer, the term of this patent is extended or adjusted under 35 U.S.C. 154(b) by 568 days.

(21) Appl. No.: 14/509,676

(22) Filed: Oct. 8, 2014

(65) Prior Publication Data

US 2015/0106084 A1 Apr. 16, 2015

Related U.S. Application Data

(60) Provisional application No. 61/889,727, filed on Oct. 11, 2013.

(51) Int. Cl.
*G10L 21/00* (2013.01)
*G10L 21/0216* (2013.01)
(Continued)

(52) U.S. Cl.
CPC ..... *G10L 21/0216* (2013.01); *G10L 19/0208* (2013.01); *G10L 19/087* (2013.01); *G10L 21/038* (2013.01); *G10L 25/78* (2013.01)

(58) Field of Classification Search
CPC ..... G11C 2207/16; G11C 7/16; H04B 1/667; G10L 19/02; G10L 19/10; G10L 19/12; G10L 19/06; G10L 19/04; G10L 19/005; G10L 21/0208; G10L 25/78; G10L 15/20; G10L 19/008; G10L 19/24
(Continued)

(56) References Cited

U.S. PATENT DOCUMENTS 6,141,638 A 10/2000 Peng et al.
6,449,313 B1 9/2002 Erzin et al.
(Continued)

FOREIGN PATENT DOCUMENTS

WO 0223536 A2 3/2002
WO 2006107837 A1 10/2006
(Continued)

OTHER PUBLICATIONS

Blamey, et al., "Formant-Based Processing for Hearing Aids," Human Communication Research Centre, University of Melbourne, pp. 273-pp. 278, Jan. 1993.
(Continued)

*Primary Examiner* — Vu B Hang
(74) *Attorney, Agent, or Firm* — Toler Law Group, P.C.

(57) ABSTRACT

A method includes generating a high-band residual signal based on a high-band portion of an audio signal. The method also includes generating a harmonically extended signal at least partially based on a low-band portion of the audio signal. The method further includes determining a mixing factor based on the high-band residual signal, the harmonically extended signal, and modulated noise. The modulated noise is at least partially based on the harmonically extended signal and white noise.

18 Claims, 6 Drawing Sheets

(51) Int. Cl.

| | |
|---|---|
| ***G10L 19/02*** | (2013.01) |
| ***G10L 19/087*** | (2013.01) |
| ***G10L 21/038*** | (2013.01) |
| *G10L 25/78* | (2013.01) |

(58) Field of Classification Search
USPC ..... 704/201, 205, 206, 219, 223, 226, 227, 704/228
See application file for complete search history.

(56) References Cited

U.S. PATENT DOCUMENTS

| | | | |
|---|---|---|---|
| 6,629,068 | B1 | 9/2003 | Horos et al. |
| 6,704,701 | B1 | 3/2004 | Gao |
| 6,766,289 | B2 | 7/2004 | Kandhadai et al. |
| 6,795,805 | B1 | 9/2004 | Bessette et al. |
| 7,117,146 | B2 | 10/2006 | Gao |
| 7,272,556 | B1 | 9/2007 | Aguilar et al. |
| 7,680,653 | B2 | 3/2010 | Yeldener |
| 7,788,091 | B2 | 8/2010 | Goudar et al. |
| 8,260,611 | B2 | 9/2012 | Vos et al. |
| 2002/0147583 | A1 | 10/2002 | Gao |
| 2003/0115042 | A1 | 6/2003 | Chen et al. |
| 2003/0128851 | A1 | 7/2003 | Furuta |
| 2004/0093205 | A1 | 5/2004 | Ashley et al. |
| 2006/0147127 | A1 | 7/2006 | Edler et al. |
| 2006/0173691 | A1 | 8/2006 | Mukaide |
| 2008/0114605 | A1 | 5/2008 | Wu et al. |
| 2008/0208575 | A1 | 8/2008 | Laaksonen et al. |
| 2009/0254783 | A1 | 10/2009 | Hirschfeld et al. |
| 2010/0241433 | A1 | 9/2010 | Herre et al. |
| 2010/0332223 | A1 | 12/2010 | Morii et al. |
| 2011/0099004 | A1 | 4/2011 | Krishnan et al. |
| 2011/0257980 | A1* | 10/2011 | Gao ..... G10L 21/038 704/500 |
| 2011/0295598 | A1 | 12/2011 | Yang et al. |
| 2012/0101813 | A1* | 4/2012 | Vaillancourt ..... G10L 19/20 704/206 |
| 2012/0101824 | A1 | 4/2012 | Chen |
| 2012/0221326 | A1 | 8/2012 | Grancharov et al. |
| 2012/0300946 | A1 | 11/2012 | Ma |
| 2012/0316885 | A1 | 12/2012 | Gibbs |
| 2012/0323571 | A1 | 12/2012 | Song et al. |
| 2013/0051571 | A1 | 2/2013 | Nagel et al. |

FOREIGN PATENT DOCUMENTS

| | | | |
|---|---|---|---|
| WO | 2006130221 | A1 | 12/2006 |
| WO | 2012158157 | A1 | 11/2012 |
| WO | 2014123585 | | 8/2014 |

OTHER PUBLICATIONS

Boillot, et al., "A Loudness Enhancement Technique for Speech," IEEE, 0-7803-8251-X/04, ISCAS 2004, pp. V-616-pp. V-619, 2004.

Cheveigne, "Formant Bandwidth Affects the Identification of Competing Vowels," CNRS—IRCAM, France, and ATR-HIP, Japan, p. 1-p.4, 1999.

Coelho, et al., "Voice Pleasantness: On the Improvement of TTS Voice Quality," Instituto Politécnico do Porto, ESEIG, Porto, Portugal, MLDC—Microsoft Language Development Center, Lisbon, Portugal, Universidade de Vigo, Dep. Teoria de la Señal e Telecomuniçõns, Vigo, Spain, p. 1-p. 6, download.microsoft.com/download/a/0/b/a0b1a66a-5ebf-4cf3-9453-4b13bb027f1f/jth08voicequality.pdf.

Cole, et al., "Speech Enhancement by Formant Sharpening in the Cepstral Domain," Proceedings of the 9th Australian International Conference on Speech Science & Technology, Australian Speech Science & Technology Association Inc., pp. 244-pp. 249, Melbourne, Australia, Dec. 2-5, 2002.

Cox, "Current Methods of Speech Coding," Signal Compression: Coding of Speech, Audio, Text, Image and Video, ed. N. Jayant, ISBN-13: 9789810237653, vol. 7, No. 1, pp. 31-pp. 39, 1997.

ISO/IEC 14496-3:2005(E), Subpart 3: Speech Coding—CELP, pp. 1-165, 2005.

Itu-T, "Series G: Transmission Systems and Media, Digital Systems and Networks, Digital terminal equipments—Coding of analogue signals by methods other than PCM, Dual rate speech coder for multimedia communications transmitting at 5.3 and 6.3 kbit/s", G.723.1, ITU-T, pp. 1-pp. 64, May 2006.

Jokinen, et al., "Comparison of Post-Filtering Methods for Intelligibility Enhancement of Telephone Speech," 20th European Signal Processing Conference (EUSIPCO 2012), ISSN 2076-1465, p. 2333-p. 2337, Bucharest, Romania, Aug. 27-31, 2012.

Taniguchi T et Al, "Pitch Sharpeing for Perceptually Improved CELP, and the Sparse-Delta Codebook for Reduced Computation", Proceedings from the International Conference on Acoustics, Speech & Signal Processing, ICASSP, pp. 241-244, Apr. 14-17, 1991.

Zorila, et al., "Improving Speech Intelligibility in Noise Environments by Spectral Shaping and Dymanic Range Compression," The Listening Talker—An Interdisciplinary Workshop on Natural and Synthetic Modification of Speech, LISTA Workshop in Response to Listening Conditions. Edinburgh, May 2-3, 2012, pp. 1.

Zorila, et al., "Improving Sppech Intelligibility in Noise Environments by Spectral Shaping and Dynamic Range Compression," Forth—Institute of Computer Science, Listening Talker, pp. 1.

Zorila, et al., "Speech-In-Noise Intelligibility Improvement Based on Power Recovery and Dynamic Range Compression," 20th European Signal Processing Conference (EUSIPCO 2012), ISSN 2076-1465, pp. 2075-pp. 2079, Bucharest, Romania, Aug. 27-31, 2012.

International Search Report and Written Opinion for International Application No. PCT/US2014/059901, ISA/EPO, dated Jan. 21, 2015, 13 pages.

Ryu S-U., et al., "Effective High Frequency Regeneration Based on Sinusoidal Modeling for MPEG-4 HE-AAC", 2005 IEEE Workshop on Applications of Signal Processing to Audio and Acoustics, Oct. 16, 2005, pp. 211-214, Retrived from the Internet: https://pdfs.semanticscholar.org/e255/8e7428725284ae3bede796c51ae82b27225d.pdf?_ga=1.75332052.711317920.1491371500.

* cited by examiner

ESTIMATION OF MIXING FACTORS TO GENERATE HIGH-BAND EXCITATION SIGNAL

I. CLAIM OF PRIORITY

The present application claims priority from U.S. Provisional Patent Application No. 61/889,727 entitled "ESTIMATION OF MIXING FACTORS TO GENERATE HIGH-BAND EXCITATION SIGNAL," filed Oct. 11, 2013, the contents of which are incorporated by reference in their entirety.

II. FIELD

The present disclosure is generally related to signal processing.

III. DESCRIPTION OF RELATED ART

Advances in technology have resulted in smaller and more powerful computing devices. For example, there currently exist a variety of portable personal computing devices, including wireless computing devices, such as portable wireless telephones, personal digital assistants (PDAs), and paging devices that are small, lightweight, and easily carried by users. More specifically, portable wireless telephones, such as cellular telephones and Internet Protocol (IP) telephones, can communicate voice and data packets over wireless networks. Further, many such wireless telephones include other types of devices that are incorporated therein. For example, a wireless telephone can also include a digital still camera, a digital video camera, a digital recorder, and an audio file player.

In traditional telephone systems (e.g., public switched telephone networks (PSTNs)), signal bandwidth is limited to the frequency range of 300 Hertz (Hz) to 3.4 kiloHertz (kHz). In wideband (WB) applications, such as cellular telephony and voice over internet protocol (VoIP), signal bandwidth may span the frequency range from 50 Hz to 7 kHz. Super wideband (SWB) coding techniques support bandwidth that extends up to around 16 kHz. Extending signal bandwidth from narrowband telephony at 3.4 kHz to SWB telephony of 16 kHz may improve the quality of signal reconstruction, intelligibility, and naturalness.

SWB coding techniques typically involve encoding and transmitting the lower frequency portion of the signal (e.g., 50 Hz to 7 kHz, also called the "low-band"). For example, the low-band may be represented using filter parameters and/or a low-band excitation signal. However, in order to improve coding efficiency, the higher frequency portion of the signal (e.g., 7 kHz to 16 kHz, also called the "high-band") may not be fully encoded and transmitted. Instead, a receiver may utilize signal modeling to predict the high-band. In some implementations, data associated with the high-band may be provided to the receiver to assist in the prediction. Such data may be referred to as "side information," and may include mixing factors to smooth evolution between sub-frames, gain information, line spectral frequencies (LSFs, also referred to as line spectral pairs (LSPs)), etc. High-band prediction using a signal model may be acceptably accurate when the low-band signal is sufficiently correlated to the high-band signal. However, in the presence of noise, the correlation between the low-band and the high-band may be weak, and the signal model may no longer be able to accurately represent the high-band. This may result in artifacts (e.g., distorted speech) at the receiver.

IV. SUMMARY

Systems and methods of estimating a mixing factor using a closed-loop analysis are disclosed. High-band encoding may involve generating a high-band excitation signal from a low-band excitation signal generated using low-band analysis (e.g., low-band linear prediction (LP) analysis). The high-band excitation signal may be generated by mixing a harmonically extended signal with modulated noise (e.g., white noise). The ratio at which the harmonically extended signal and the modulated noise are mixed may impact signal reconstruction quality. In the presence of background noise, the correlation between the low-band and the high-band may be compromised and the harmonically extended signal may be inadequate for high-band synthesis. For example, the high-band excitation signal may introduce audible artifacts caused by low-band fluctuations within a frame that are independent of the high-band. In accordance with the described techniques, the ratio at which the harmonically extended signal and the modulated noise are mixed may be adjusted based on a signal representative of the high-band (e.g., a high-band residual signal). For example, the techniques described herein may enable a closed-loop estimation of a mixing factor used to determine the ratio at which the harmonically extended signal and the modulated noise are mixed. The closed-loop estimation may reduce (e.g., minimize) a difference between the high-band excitation signal and the high-band residual signal, thus generating a high-band excitation signal that is less susceptible to fluctuations in the low-band and more representative of the high-band.

In a particular embodiment, a method includes generating, at a speech encoder, a high-band residual signal based on a high-band portion of an audio signal. The method also includes generating a harmonically extended signal at least partially based on a low-band portion of the audio signal. The method further includes determining a mixing factor based on the high-band residual signal, the harmonically extended signal, and modulated noise. The modulated noise is at least partially based on the harmonically extended signal and white noise.

In another particular embodiment, an apparatus includes a linear prediction analysis filter to generate a high-band residual signal based on a high-band portion of an audio signal. The apparatus also includes a non-linear transformation generator to generate a harmonically extended signal at least partially based on a low-band portion of the audio signal. The apparatus further includes a mixing factor calculator to determine a mixing factor based on the high-band residual signal, the harmonically extended signal, and modulated noise. The modulated noise is at least partially based on the harmonically extended signal and white noise.

In another particular embodiment, a non-transitory computer readable medium includes instructions that, when executed by a processor, cause the processor to generate a high-band residual signal based on a high-band portion of an audio signal. The instructions are also executable to cause the processor to generate a harmonically extended signal at least partially based on a low-band portion of the audio signal. The instructions are also executable to cause the processor to determine a mixing factor based on the high-band residual signal, the harmonically extended signal, and modulated noise. The modulated noise is at least partially based on the harmonically extended signal and white noise.

In another particular embodiment, an apparatus includes means for generating a high-band residual signal based on a high-band portion of an audio signal. The apparatus also includes means for generating a harmonically extended signal at least partially based on a low-band portion of the audio signal. The apparatus further includes means for determining a mixing factor based on the high-band residual signal, the harmonically extended signal, and modulated noise. The modulated noise is at least partially based on the harmonically extended signal and white noise.

In another particular embodiment, a method includes receiving, at a speech decoder, an encoded signal including low-band excitation signal and high-band side information. The high-band side information includes a mixing factor determined based on a high-band residual signal, a harmonically extended signal, and modulated noise. The method also includes generating a high-band excitation signal based on the high-band side information and the low-band excitation signal.

In another particular embodiment, an apparatus includes a speech decoder configured to receive an encoded signal including low-band excitation signal and high-band side information. The high-band side information includes a mixing factor determined based on a high-band residual signal, a harmonically extended signal, and modulated noise. The speech decoder is further configured to generate a high-band excitation signal based on the high-band side information and the low-band excitation signal.

In another particular embodiment, a method includes means for receiving an encoded signal including low-band excitation signal and high-band side information. The high-band side information includes a mixing factor determined based on a high-band residual signal, a harmonically extended signal, and modulated noise. The apparatus also includes means for generating a high-band excitation signal based on the high-band side information and the low-band excitation signal.

In another particular embodiment, a non-transitory computer readable medium includes instructions that, when executed by a processor, cause the processor to receive an encoded signal including low-band excitation signal and high-band side information. The high-band side information includes a mixing factor determined based on a high-band residual signal, a harmonically extended signal, and modulated noise. The instructions are also executable to cause the processor to generate a high-band excitation signal based on the high-band side information and the low-band excitation signal.

Particular advantages provided by at least one of the disclosed embodiments include an ability to dynamically adjust mixing factors used during high-band synthesis based on characteristics from the high-band. For example, mixing factors may be determined using a closed-loop analysis to reduce an error between a high-band residual signal and a high-band excitation signal used during high-band synthesis. Other aspects, advantages, and features of the present disclosure will become apparent after review of the entire application, including the following sections: Brief Description of the Drawings, Detailed Description, and the Claims.

V. BRIEF DESCRIPTION OF THE DRAWINGS

Figure 3:
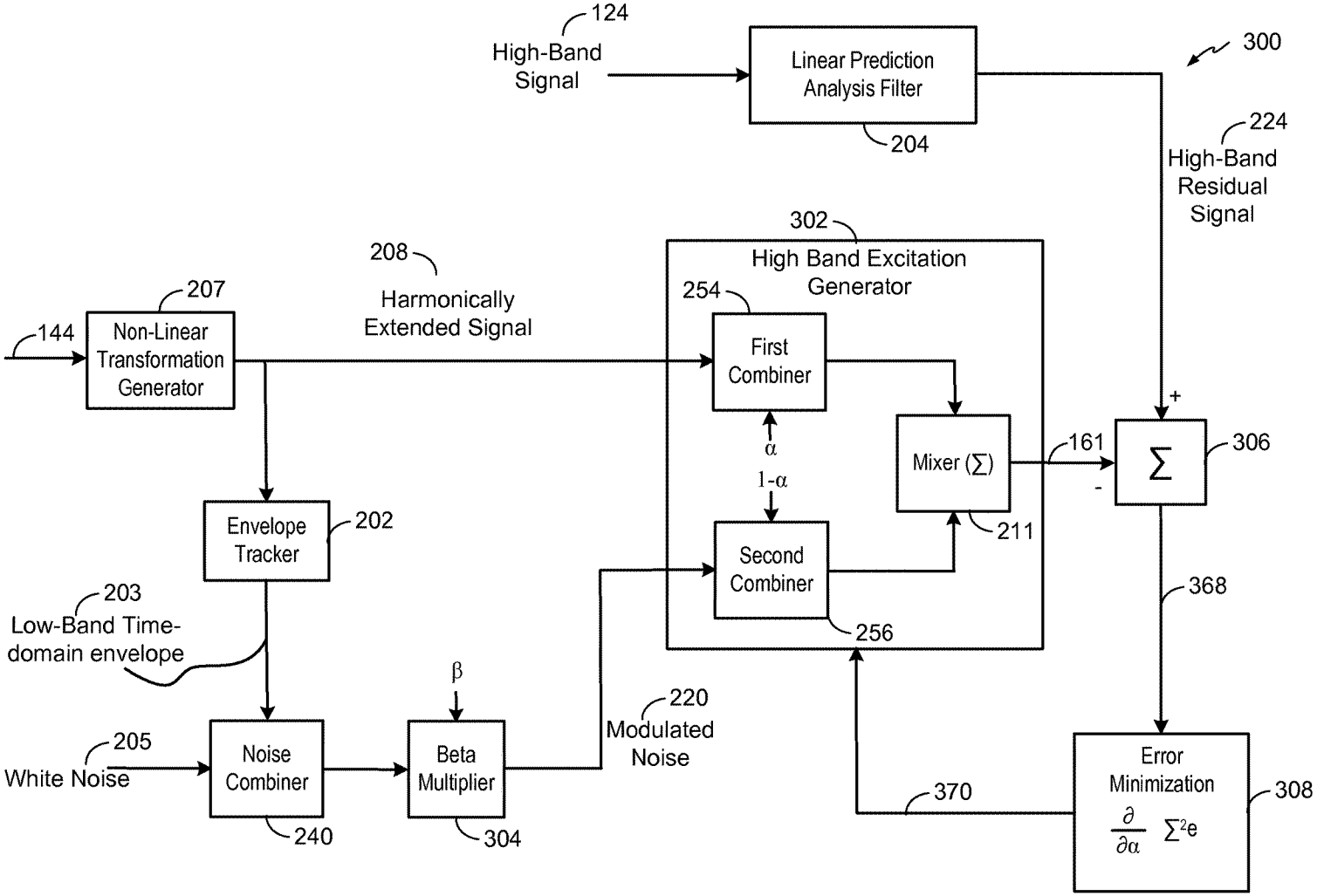
FIG. 3 is a diagram to illustrate another particular embodiment of a system that is operable to estimate a mixing factor using a closed-loop analysis to generate a high-band excitation signal.
Figure 4:
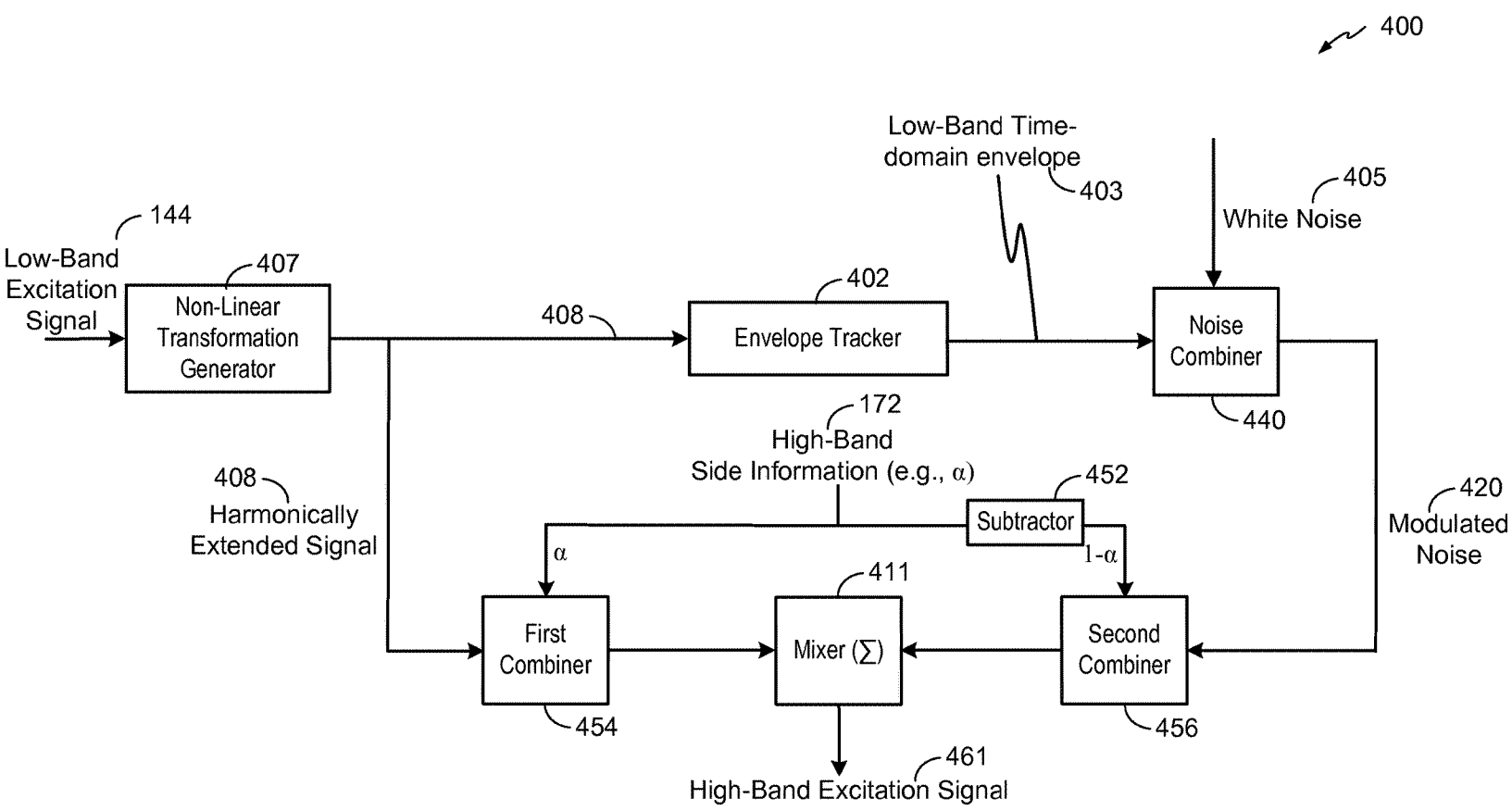
FIG. 4 is a diagram to illustrate a particular embodiment of a system that is operable to reproduce an audio signal using a mixing factor.
Figure 5:
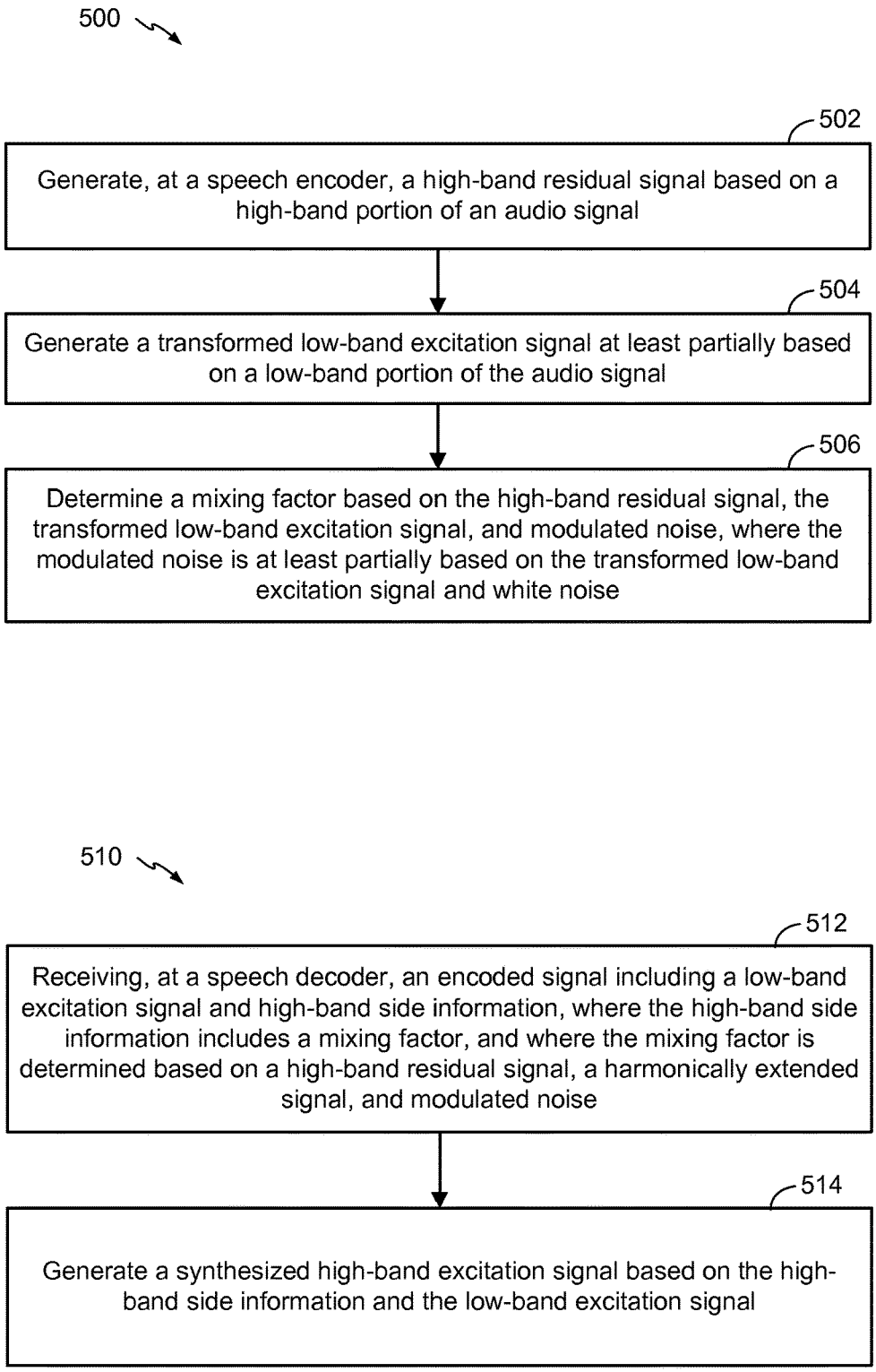
Figure 6:
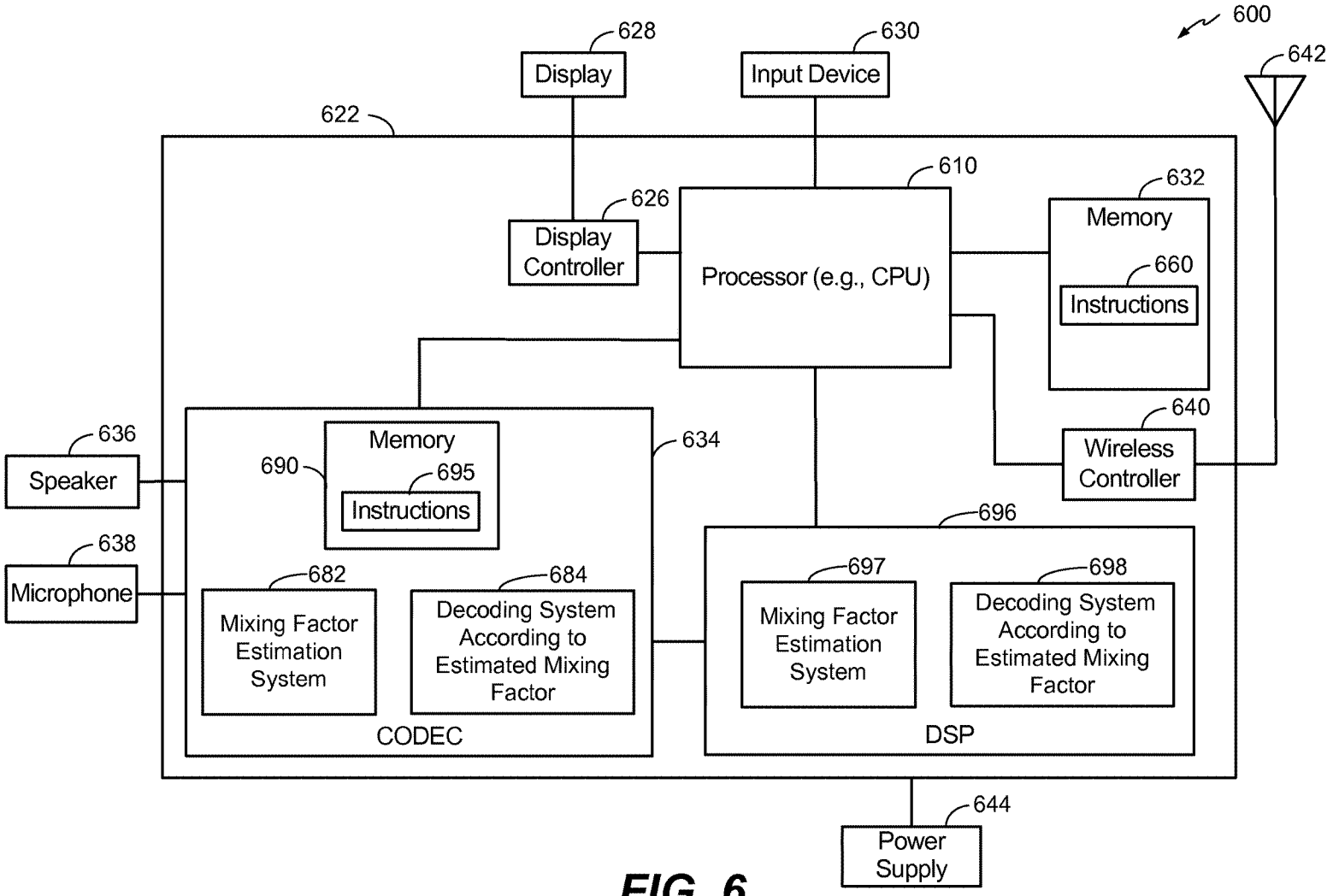

FIG. 5 includes flowcharts to illustrate particular embodiments of methods for reproducing a high-band signal using a mixing factor; and FIG. 6 is a block diagram of a wireless device operable to perform signal processing operations in accordance with the systems and methods of FIGS. 1-5.

VI. DETAILED DESCRIPTION

Figure 1:
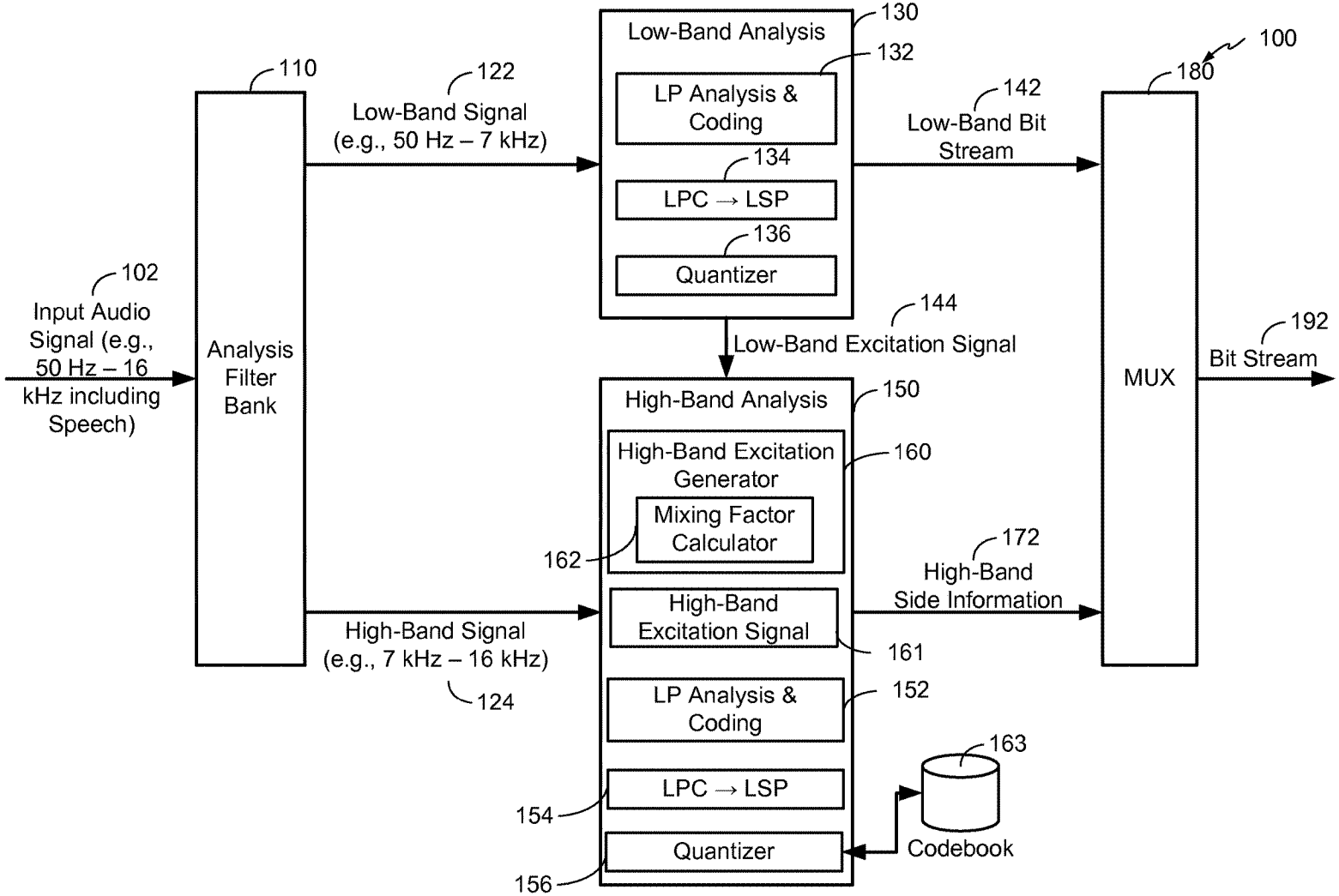
FIG. 1 is a diagram to illustrate a particular embodiment of a system that is operable to estimate a mixing factor.

Referring to FIG. 1, a particular embodiment of a system that is operable to estimate a mixing factor (e.g., using closed-loop analysis) is shown and generally designated 100. In a particular embodiment, the system 100 may be integrated into an encoding system or apparatus (e.g., in a wireless telephone or coder/decoder (CODEC)). In other particular embodiments, the system 100 may be integrated into a set top box, a music player, a video player, an entertainment unit, a navigation device, a communications device, a PDA, a fixed location data unit, or a computer.

It should be noted that in the following description, various functions performed by the system 100 of FIG. 1 are described as being performed by certain components or modules. However, this division of components and modules is for illustration only. In an alternate embodiment, a function performed by a particular component or module may instead be divided amongst multiple components or modules. Moreover, in an alternate embodiment, two or more components or modules of FIG. 1 may be integrated into a single component or module. Each component or module illustrated in FIG. 1 may be implemented using hardware (e.g., a field-programmable gate array (FPGA) device, an application-specific integrated circuit (ASIC), a digital signal processor (DSP), a controller, etc.), software (e.g., instructions executable by a processor), or any combination thereof.

The system 100 includes an analysis filter bank 110 that is configured to receive an input audio signal 102. For example, the input audio signal 102 may be provided by a microphone or other input device. In a particular embodiment, the input audio signal 102 may include speech. The input audio signal 102 may be a SWB signal that includes data in the frequency range from approximately 50 Hz to approximately 16 kHz. The analysis filter bank 110 may filter the input audio signal 102 into multiple portions based on frequency. For example, the analysis filter bank 110 may generate a low-band signal 122 and a high-band signal 124. The low-band signal 122 and the high-band signal 124 may have equal or unequal bandwidths, and may be overlapping or non-overlapping. In an alternate embodiment, the analysis filter bank 110 may generate more than two outputs.

In the example of FIG. 1, the low-band signal 122 and the high-band signal 124 occupy non-overlapping frequency bands. For example, the low-band signal 122 and the high-band signal 124 may occupy non-overlapping frequency bands of 50 Hz-7 kHz and 7 kHz-16 kHz. In an alternate embodiment, the low-band signal 122 and the high-band signal 124 may occupy non-overlapping frequency bands of 50 Hz-8 kHz and 8 kHz-16 kHz, respectively. In an another alternate embodiment, the low-band signal 122 and the high-band signal 124 overlap (e.g., 50 Hz-8 kHz and 7 kHz-16 kHz, respectively), which may enable a low-pass filter and a high-pass filter of the analysis filter bank 110 to have a smooth rolloff, which may simplify design and reduce cost of the low-pass filter and the high-pass filter. Overlapping the low-band signal 122 and the high-band signal 124 may also enable smooth blending of low-band and high-band signals at a receiver, which may result in fewer audible artifacts.

It should be noted that although the example of FIG. 1 illustrates processing of a SWB signal, this is for illustration only. In an alternate embodiment, the input audio signal 102 may be a WB signal having a frequency range of approximately 50 Hz to approximately 8 kHz. In such an embodiment, the low-band signal 122 may correspond to a frequency range of approximately 50 Hz to approximately 6.4 kHz and the high-band signal 124 may correspond to a frequency range of approximately 6.4 kHz to approximately 8 kHz.

The system 100 may include a low-band analysis module 130 configured to receive the low-band signal 122. In a particular embodiment, the low-band analysis module 130 may represent an embodiment of a code excited linear prediction (CELP) encoder. The low-band analysis module 130 may include an LP analysis and coding module 132, a linear prediction coefficient (LPC) to LSP transform module 134, and a quantizer 136. LSPs may also be referred to as LSFs, and the two terms (LSP and LSF) may be used interchangeably herein. The LP analysis and coding module 132 may encode a spectral envelope of the low-band signal 122 as a set of LPCs. LPCs may be generated for each frame of audio (e.g., 20 milliseconds (ms) of audio, corresponding to 320 samples at a sampling rate of 16 kHz), each sub-frame of audio (e.g., 5 ms of audio), or any combination thereof. The number of LPCs generated for each frame or sub-frame may be determined by the "order" of the LP analysis performed. In a particular embodiment, the LP analysis and coding module 132 may generate a set of eleven LPCs corresponding to a tenth-order LP analysis.

The LPC to LSP transform module 134 may transform the set of LPCs generated by the LP analysis and coding module 132 into a corresponding set of LSPs (e.g., using a one-to-one transform). Alternately, the set of LPCs may be one-to-one transformed into a corresponding set of parcor coefficients, log-area-ratio values, immittance spectral pairs (ISPs), or immittance spectral frequencies (ISFs). The transform between the set of LPCs and the set of LSPs may be reversible without error.

The quantizer 136 may quantize the set of LSPs generated by the transform module 134. For example, the quantizer 136 may include or be coupled to multiple codebooks that include multiple entries (e.g., vectors). To quantize the set of LSPs, the quantizer 136 may identify entries of codebooks that are "closest to" (e.g., based on a distortion measure such as least squares or mean square error) the set of LSPs. The quantizer 136 may output an index value or series of index values corresponding to the location of the identified entries in the codebook. The output of the quantizer 136 may thus represent low-band filter parameters that are included in a low-band bit stream 142.

The low-band analysis module 130 may also generate a low-band excitation signal 144. For example, the low-band excitation signal 144 may be an encoded signal that is generated by quantizing a LP residual signal that is generated during the LP process performed by the low-band analysis module 130. The LP residual signal may represent prediction error.

The system 100 may further include a high-band analysis module 150 configured to receive the high-band signal 124 from the analysis filter bank 110 and the low-band excitation signal 144 from the low-band analysis module 130. The high-band analysis module 150 may generate high-band side information 172 based on the high-band signal 124 and the low-band excitation signal 144. For example, the high-band side information 172 may include high-band LSPs, gain information, and mixing factors (a), as further described herein.

The high-band analysis module 150 may include a high-band excitation generator 160. The high-band excitation generator 160 may generate a high-band excitation signal 161 by extending a spectrum of the low-band excitation signal 144 into the high-band frequency range (e.g., 7 kHz-16 kHz). To illustrate, the high-band excitation generator 160 may apply a transform to the low-band excitation signal 144 (e.g., a non-linear transform such as an absolute-value or square operation) and may mix the harmonically extended signal with a noise signal (e.g., white noise modulated according to an envelope corresponding to the low-band excitation signal 144 that mimics slow varying temporal characteristics of the low-band signal 122) to generate the high-band excitation signal 161. For example, the mixing may be performed according to the following equation:

$$\text{High-band excitation}=(\alpha*\text{harmonically extended})+((1-\alpha)*\text{modulated noise})$$

The ratio at which the harmonically extended signal and the modulated noise are mixed may impact high-band reconstruction quality at a receiver. For voiced speech signals, the mixing may be biased towards the harmonically extended (e.g., the mixing factor $\alpha$ may be in the range of 0.5 to 1.0). For unvoiced signals, the mixing may be biased towards the modulated noise (e.g., the mixing factor $\alpha$ may be in the range of 0.0 to 0.5).

In some circumstances, the harmonically extended signal may be inadequate for use in high-band synthesis due to insufficient correlation between the high-band signal 124 and a noisy low-band signal 122. For example, the low-band signal 122 (and thus the harmonically extended signal) may include frequent fluctuations that may not be mimicked in the high-band signal 124. Typically, the mixing factor $\alpha$ may be determined based on low-band voicing parameters that mimic a strength of a particular frame associated with a voiced sound and a strength of the particular frame associated with an unvoiced sound. However, in the presence of noise, determining the mixing factor $\alpha$ in such fashion may result in wide fluctuations per sub-frame. For example, due to noise, the mixing factor $\alpha$ for four consecutive sub-frames may be 0.9, 0.25, 0.8, and 0.15, resulting in buzzy or modulation artifacts. Moreover, a large amount of quantization distortion may be present.

Figure 2:
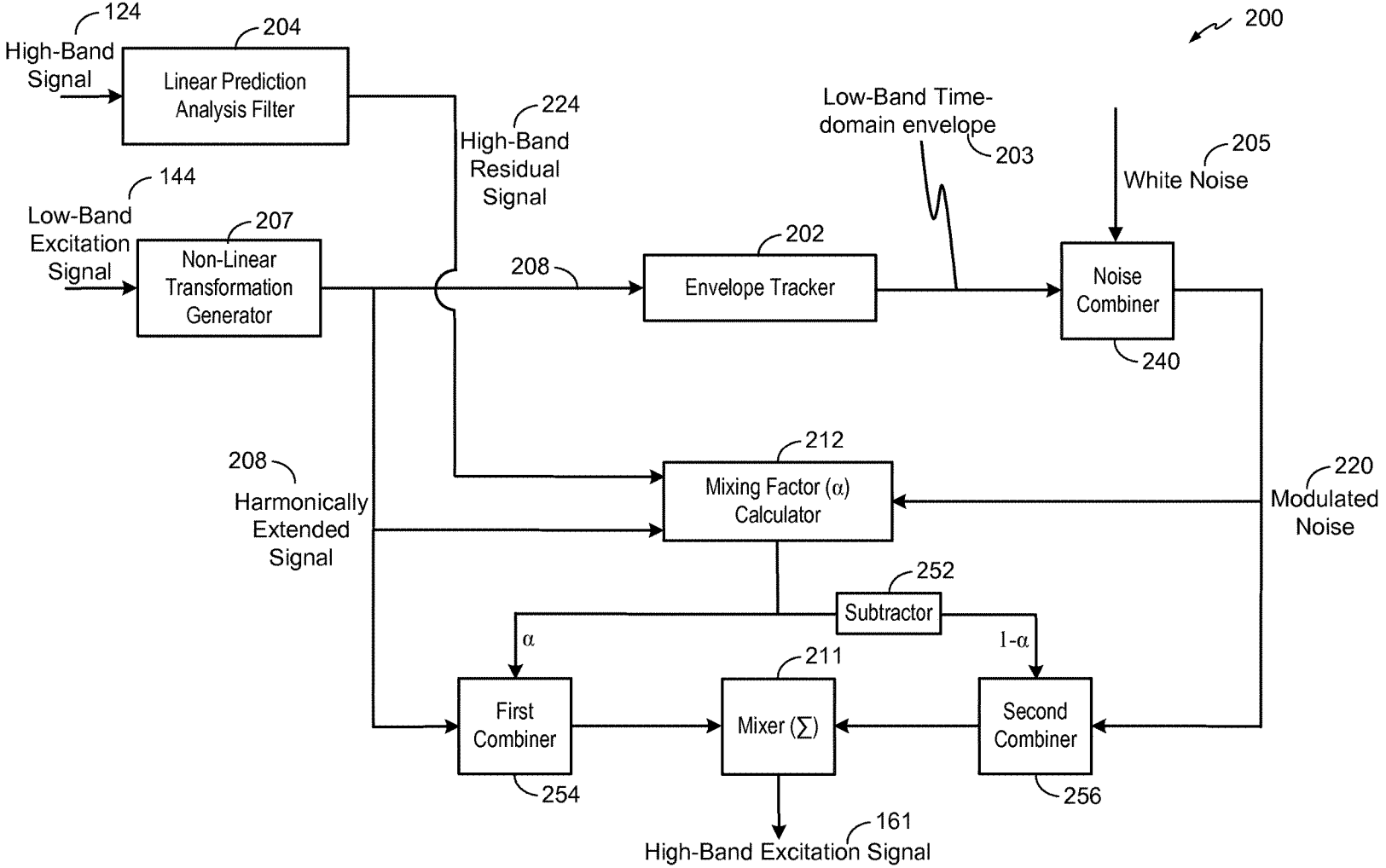
FIG. 2 is a diagram to illustrate a particular embodiment of a system that is operable to estimate a mixing factor to generate a high-band excitation signal.

Thus, the high-band excitation generator 160 may include a mixing factor calculator 162 to estimate the mixing factor $\alpha$ as described with respect to FIGS. 2-3. For example, the mixing factor calculator 162 may generate a mixing factor ($\alpha$) based on characteristics of the high-band signal 124. For example, a residual of the high-band signal 124 may be used to estimate the mixing factor ($\alpha$). In a particular embodiment, the mixing factor calculator 162 may generate a mixing factor ($\alpha$) that reduces the mean square error of the difference between the residual of the high-band signal 124 and the high-band excitation signal 161. The residual of the high-band signal 124 may be generated by performing a linear prediction analysis on the high-band signal 124 (e.g., by encoding a spectral envelope of the high-band signal 124)

to generate a set of LPCs. For example, the high-band analysis module 150 may also include an LP analysis and coding module 152, a LPC to LSP transform module 154, and a quantizer 156. The LP analysis and coding module 152 may generate the set of LPCs. The set of LPCs may be transformed to LSPs by the transform module 154 and quantized by the quantizer 156 based on a codebook 163.

The high-band excitation signal 161 may be used to determine one or more high-band gain parameters that are included in the high-band side information 172. Each of the LP analysis and coding module 152, the transform module 154, and the quantizer 156 may function as described above with reference to corresponding components of the low-band analysis module 130, but at a comparatively reduced resolution (e.g., using fewer bits for each coefficient, LSP, etc.). The LP analysis and coding module 152 may generate a set of LPCs that are transformed to LSPs by the transform module 154 and quantized by the quantizer 156 based on the codebook 163. For example, the LP analysis and coding module 152, the transform module 154, and the quantizer 156 may use the high-band signal 124 to determine high-band filter information (e.g., high-band LSPs) that is included in the high-band side information 172. In a particular embodiment, the high-band side information 172 may include high-band LSPs, the high-band gain parameters, and the mixing factors ($\alpha$).

The low-band bit stream 142 and the high-band side information 172 may be multiplexed by a multiplexer (MUX) 180 to generate an output bit stream 192. The output bit stream 192 may represent an encoded audio signal corresponding to the input audio signal 102. For example, the output bit stream 192 may be transmitted (e.g., over a wired, wireless, or optical channel) and/or stored. At a receiver, reverse operations may be performed by a demultiplexer (DEMUX), a low-band decoder, a high-band decoder, and a filter bank to generate an audio signal (e.g., a reconstructed version of the input audio signal 102 that is provided to a speaker or other output device). The number of bits used to represent the low-band bit stream 142 may be substantially larger than the number of bits used to represent the high-band side information 172. Thus, most of the bits in the output bit stream 192 may represent low-band data. The high-band side information 172 may be used at a receiver to regenerate the high-band excitation signal from the low-band data in accordance with a signal model. For example, the signal model may represent an expected set of relationships or correlations between low-band data (e.g., the low-band signal 122) and high-band data (e.g., the high-band signal 124). Thus, different signal models may be used for different kinds of audio data (e.g., speech, music, etc.), and the particular signal model that is in use may be negotiated by a transmitter and a receiver (or defined by an industry standard) prior to communication of encoded audio data. Using the signal model, the high-band analysis module 150 at a transmitter may be able to generate the high-band side information 172 such that a corresponding high-band analysis module at a receiver is able to use the signal model to reconstruct the high-band signal 124 from the output bit stream 192.

The quantizer 156 may be configured to quantize a set of spectral frequency values, such as LSPs provided by the transformation module 154. In other embodiments, the quantizer 156 may receive and quantize sets of one or more other types of spectral frequency values in addition to, or instead of, LSFs or LSPs. For example, the quantizer 156 may receive and quantize a set of LPCs generated by the LP analysis and coding module 152. Other examples include sets of parcor coefficients, log-area-ratio values, and ISFs that may be received and quantized at the quantizer 156. The quantizer 156 may include a vector quantizer that encodes an input vector (e.g., a set of spectral frequency values in a vector format) as an index to a corresponding entry in a table or codebook, such as the codebook 163. As another example, the quantizer 156 may be configured to determine one or more parameters from which the input vector may be generated dynamically at a decoder, such as in a sparse codebook embodiment, rather than retrieved from storage. To illustrate, sparse codebook examples may be applied in coding schemes such as CELP and codecs according to industry standards such as 3GPP2 (Third Generation Partnership 2) EVRC (Enhanced Variable Rate Codec). In another embodiment, the high-band analysis module 150 may include the quantizer 156 and may be configured to use a number of codebook vectors to generate synthesized signals (e.g., according to a set of filter parameters) and to select one of the codebook vectors associated with the synthesized signal that best matches the high-band signal 124, such as in a perceptually weighted domain.

The system 100 may reduce artifacts that may arise due to over-estimation of temporal and gain parameters. For example, the mixing factor calculator 162 may determine the mixing factor ($\alpha$) using a closed-loop analysis to improve accuracy of a high-band estimate during high-band prediction. Improving the accuracy of the high-band estimate may reduce artifacts in scenarios where increased noise reduces a correlation between the low-band and the high-band. The high-band analysis module 150 may predict the high-band using characteristics (e.g., the high-band residual signal) of the high-band and estimate a mixing factor ($\alpha$) to produce a high-band excitation signal 161 that models the high-band residual signal. The high-band analysis module 150 may transmit the mixing factor ($\alpha$) to the receiver along with the other high-band side information 172, which may enable the receiver to perform reverse operations to reconstruct the input audio signal 102.

Referring to FIG. 2, a particular illustrative embodiment of a system 200 that is operable to estimate a mixing factor to generate a high-band excitation signal is shown. The system 200 includes a linear prediction analysis filter 204, a non-linear transformation generator 207, a mixing factor calculator 212, and a mixer 211. The system 200 may be implemented using the high-band analysis module 150 of FIG. 1. In a particular embodiment, the mixing factor calculator 212 may correspond to the mixing factor calculator 162 of FIG. 1.

The high-band signal 124 may be provided to the linear prediction analysis filter 204. The linear prediction analysis filter 204 may be configured to generate a high-band residual signal 224 based on the high-band signal 124 (e.g., a high-band portion of the input audio signal 102). For example, the linear prediction analysis filter 204 may encode a spectral envelope of the high-band signal 124 as a set of the LPCs used to predict future samples of the high-band signal 124. The high-band residual signal 224 may be used to predict the error of the high-band excitation signal 161. The high-band residual signal 224 may be provided to a first input of the mixing factor calculator 212.

The low-band excitation signal 144 may be provided to the non-linear transformation generator 207. As described with respect to FIG. 1, the low-band excitation signal 144 may be generated from the low-band signal 122 (e.g., the low-band portion of the input audio signal 102) using the low-band analysis module 130. The non-linear transformation generator 207 may be configured to generate a harmonically extended signal 208 based on the low-band excitation signal 144. For example, the non-linear transformation generator 207 may perform an absolute-value operation or a square operation on frames of the low-band excitation signal 144 to generate the harmonically extended signal 208.

To illustrate, the non-linear excitation generator 207 may up-sample the low-band excitation signal 144 (e.g., an 8 kHz signal ranging from approximately 0 kHz to 8 kHz) to generate a 16 kHz signal ranging from approximately 0 kHz to 16 kHz (e.g., a signal having approximately twice the bandwidth of the low-band excitation signal 144). A low-band portion of the 16 kHz signal (e.g., approximately from 0 kHz to 8 kHz) may have substantially similar harmonics as the low-band excitation signal 144, and a high-band portion of the 16 kHz signal (e.g., approximately from 8 kHz to 16 kHz) may be substantially free of harmonics. The non-linear transformation generator 204 may extend the "dominant" harmonics in the low-band portion of the 16 kHz signal to the high-band portion of the 16 kHz signal to generate the harmonically extended signal 208. Thus, the harmonically extended signal 208 may be a harmonically extended version of the low-band excitation signal 144 that extends into the high-band using non-linear operations (e.g., square operations and/or absolute value operations). The harmonically extended signal 208 may be provided to an input of an envelope tracker 202, to a second input of the mixing factor calculator 212, and to a first input of a first combiner 254.

The envelope tracker 202 may be configured to receive the harmonically extended signal 208 and to calculate a low-band time-domain envelope 203 corresponding to the harmonically extended signal 208. For example, the envelope tracker 202 may be configured to calculate the square of each sample of a frame of the harmonically extended signal 208 to produce a sequence of squared values. The envelope tracker 202 may be configured to perform a smoothing operation on the sequence of squared values, such as by applying a first order infinite impulse response (IIR) low-pass filter to the sequence of squared values. The envelope tracker 202 may be configured to apply a square root function to each sample of the smoothed sequence to produce the low-band time-domain envelope 203. The low-band time-domain envelope 203 may be provided to a first input of a noise combiner 240.

The noise combiner 240 may be configured to combine the low-band time-domain envelope 203 with white noise 205 generated by a white noise generator (not shown) to produce a modulated noise signal 220. For example, the noise combiner 240 may be configured to amplitude-modulate the white noise 205 according to the low-band time-domain envelope 203. In a particular embodiment, the noise combiner 240 may be implemented as a multiplier that is configured to scale the white noise 205 according to the low-band time-domain envelope 203 to produce the modulated noise signal 220. The modulated noise signal 220 may be provided to a third input of the mixing calculator 212 and to a first input of a second combiner 256.

The mixing factor calculator 212 may be configured to determine a mixing factor ($\alpha$) based on the high-band residual signal 224, the harmonically extended signal 208, and the modulated noise signal 220. The mixing factor calculator 212 may determine the mixing factor ($\alpha$). For example, the mixing factor calculator 212 may determine the mixing factor ($\alpha$) based on a mean square error (E) of a difference between the high-band residual signal 224 and the high-band excitation signal 161. The high-band excitation signal 161 may be expressed according to the following equation:

$$\check{R}_{HB}=\alpha*\acute{R}_{LB}+(1-\alpha)*\hat{W}_{MOD}, \quad \text{(Equation 1)}$$

where $\check{R}_{HB}$ corresponds to the high-band excitation signal 161, $\alpha$ corresponds to the mixing factor, $\acute{R}_{LB}$ corresponds to the harmonically extended signal 208, and $\hat{W}_{MOD}$ corresponds to the modulated noise signal 220. The high-band residual signal 224 may be expressed as $R_{HB}$.

Thus, the error (e) may correspond to the difference between the high-band residual signal 224 and the high-band excitation signal 161 and may be expressed according to the following equation:

$$e=R_{HB}-\check{R}_{HB}. \quad \text{(Equation 2)}$$

By substituting the expression for the high-band excitation signal 161 described in Equation 1 into Equation 2, the error (e) may be expressed as a difference between the high-band residual signal 224 and the high-band excitation signal 161, and may be expressed according to the following equation:

$$e=R_{HB}-[\alpha*\acute{R}_{LB}+(1-\alpha)*\hat{W}_{MOD}]. \quad \text{(Equation 3)}$$

Thus, the mean square error (E) of the difference between the high-band residual signal 224 and the high-band excitation signal 161 may be expressed according to the following equation:

$$E=(R_{HB}-[\alpha*\acute{R}_{LB}+(1-\alpha)*\hat{W}_{MOD}]. \quad \text{(Equation 4)}$$

The high-band excitation signal 161 may be made approximately equal to the high-band residual signal 224 by reducing the mean square error (E) (e.g., setting the mean square error (E) to zero). By minimizing the mean square error (E) in Equation 4, the mixing factor ($\alpha$) may be expressed according to the following equation:

$$\alpha=[(R_{HB}-\hat{W}_{MOD})*(\acute{R}_{LB}-\hat{W}_{MOD})]/(\acute{R}_{LB}-\hat{W}_{MOD})^2. \quad \text{(Equation 5)}$$

In a particular embodiment, energies of the high-band residual signal 224 and the harmonically extended signal 208 may be normalized prior to calculating the mixing factor ($\alpha$) using Equation 5. The mixing factor ($\alpha$) may be estimated for every frame (or sub-frame) and transmitted to the receiver with the output bit stream 192 along with other high-band side information 172 (e.g., high-band LSPs as well as high-band gain parameters) as described with respect to FIG. 1.

The mixing factor calculator 212 may provide the estimated mixing factor ($\alpha$) to a second input of the first combiner 254 and to an input of a subtractor 252. The subtractor 252 may subtract the mixing factor ($\alpha$) from one and provide the difference ($1-\alpha$) to a second input of the second combiner 256. The first combiner 254 may be implemented as a multiplier that is configured to scale the harmonically extended signal 208 according to the mixing factor ($\alpha$) to generate a first scaled signal. The second combiner 256 may be implemented as a multiplier that is configured to scale the modulated noise signal 220 based on the factor ($1-\alpha$) to generate a second scaled signal. For example, the second combiner 256 may scale the modulated noise signal 220 based on the difference ($1-\alpha$) generated at the subtractor 252. The first scaled signal and the second scaled signal may be provided to the mixer 211.

The mixer 211 may generate the high-band excitation signal 161 based on the mixing factor ($\alpha$), the harmonically extended signal 208, and the modulated noise signal 220. For example, the mixer 211 may combine (e.g., add) the first scaled signal and the second scaled signal to generate the high-band excitation signal 161.

In a particular embodiment, the mixing factor calculator 212 may be configured to generate the mixing factors ($\alpha$) as multiple mixing factors ($\alpha$) for each frame of the audio signal. For example, four mixing factors $\alpha_1$, $\alpha_2$, $\alpha_3$, $\alpha_4$ may be generated for a frame of an audio signal, and each mixing factor ($\alpha$) may correspond to a respective sub-frame of the frame.

The system 200 of FIG. 2 may estimate the mixing factor ($\alpha$) to improve accuracy of a high-band estimate during high-band prediction. For example, the mixing factor calculator 212 may estimate a mixing factor ($\alpha$) that would produce a high-band excitation signal 161 that is approximately equivalent to the high-band residual signal 224. Thus, in scenarios where increased noise reduces a correlation between the low-band and the high-band, the system 200 may predict the high-band using characteristics (e.g., the high-band residual signal 224) of the high-band. Transmitting the mixing factor ($\alpha$) to the receiver along with the other high-band side information 172 may enable the receiver to perform reverse operations to reconstruct the input audio signal 102.

Referring to FIG. 3, another particular illustrative embodiment of a system 300 that is operable to estimate a mixing factor ($\alpha$) using a closed-loop analysis to generate a high-band excitation signal is shown. The system 300 includes the envelope tracker 202, the linear prediction analysis filter 204, the non-linear transformation generator 207, and the noise combiner 240.

The output of the noise combiner 240 in FIG. 3 may be scaled by a noise scaling factor ($\beta$) using a Beta multiplier 304 to generate the modulated noise signal 220. The Beta multiplier 304 is a power normalization factor between the modulated white noise and the harmonic extension of the low-band excitation. The modulated noise signal 220 and the harmonically extended signal 208 may be provided to a high-band excitation generator 302. For example, the harmonically extended signal 208 may be provide to the first combiner 254 and the modulated noise signal 220 may be provided to the second combiner 220.

The system 300 may selectively increment and/or decrement values of the mixing factor ($\alpha$) to find the mixing factor ($\alpha$) that reduces (e.g., minimizes) the mean square error (E) of the difference between the high-band residual signal 224 and the high-band excitation signal 161, as described with respect to FIG. 2. For example, the linear prediction analysis filter 204 may provide the high-band residual signal 224 to a first input of the error detection circuit 306. The high-band excitation generator 302 may provide the high-band excitation signal 161 to a second input of the error detection circuit 306. The error detection circuit 306 may determine the difference (e) between the high-band residual signal 224 and the high-band excitation signal 161 according to Equation 3. The difference may be represented by an error signal 368. The error signal 368 may be provided to an input of an error minimization calculator 308 (e.g., an error controller).

The error minimization calculator 308 may calculate the mean square error (E), according to Equation 4, for a particular value of the mixing factor ($\alpha$). The error minimization calculator 308 may send a signal 370 to the high-band excitation generator 302 to selectively increment or decrement the particular value of the mixing factor ($\alpha$) to produce a smaller mean square error (E).

During operation, the error minimization calculator 308 may compute a first mean square error ($E_1$) based on a first mixing factor ($\alpha_1$). In a particular embodiment, upon calculating the first mean square error ($E_1$), the error minimization calculator 308 may send a signal 370 to the high-band excitation generator 302 to increment the first mixing factor ($\alpha_1$) by a particular amount to generate a second mixing factor ($\alpha_2$). The error minimization calculator 308 may compute a second mean square error ($E_2$) based on the second mixing factor ($\alpha_2$), and may send a signal 370 to the high-band excitation generator 302 to increment the second mixing factor ($\alpha_2$) by the particular amount to generate a third mixing factor ($\alpha_3$). This process may be repeated to generate multiple values of the mean square error (E). The error minimization calculator 308 may determine which value of the mean square error (E) is the lowest value, and the mixing factor ($\alpha$) may correspond to the particular value that yields the lower value for the mean square error (E).

In another particular embodiment, upon calculating the first mean square error ($E_1$), the error minimization calculator 308 may send a signal 370 to the high-band excitation generator 302 to decrement the first mixing factor ($\alpha_1$) by a particular amount to generate a second mixing factor ($\alpha_2$). The error minimization calculator 308 may compute a second mean square error ($E_2$) based on the second mixing factor ($\alpha_2$), and may send a signal 370 to the high-band excitation generator 302 to decrement the second mixing factor ($\alpha_2$) by the particular amount to generate a third mixing factor ($\alpha_3$). This process may be repeated to generate multiple values of the mean square error (E). The error minimization calculator 308 may determine which value of the mean square error (E) is the lowest value, and the mixing factor ($\alpha$) may correspond to the particular value that yields the lower value for the mean square error (E).

In a particular embodiment, multiple mixing factors ($\alpha$) may be used for each frame of the audio signal. For example, four mixing factors $\alpha_1$, $\alpha_2$, $\alpha_3$, $\alpha_4$ may be generated for a frame of an audio signal, and each mixing factor ($\alpha$) may correspond to a respective sub-frame of the frame. The values of the mixing factors ($\alpha$) may be incremented and/or decremented to adaptively smooth the mixing factors ($\alpha$) within a single frame or across multiple frames to reduce an occurrence and/or extent of fluctuations of the output mixing factors ($\alpha$). To illustrate, the first value of the mixing factor ($\alpha_1$) may correspond to a first sub-frame of a particular frame and the second value of the mixing factor ($\alpha_2$) may correspond to a second sub-frame of the particular frame. A third value of the mixing factor ($\alpha_3$) may be at least partially based on the first value of the mixing factor ($\alpha_1$) and the second value of the mixing factor ($\alpha_2$).

The system 300 of FIG. 3 may determine the mixing factor ($\alpha$) using a closed-loop analysis to improve accuracy of a high-band estimate during high-band prediction. For example, the error detection circuit 306 and the error minimization calculator 308 may determine the value of the mixing factor ($\alpha$) that would produce a small mean square error (E) (e.g., produce a high-band excitation signal 161 that closely mimics the high band residual signal 224). Thus, in scenarios where increased noise reduces a correlation between the low-band and the high-band, the system 300 may predict the high-band using characteristics (e.g., the high-band residual signal 224) of the high-band. Transmitting the mixing factor ($\alpha$) to the receiver along with the other high-band side information 172 may enable the receiver to perform reverse operations to reconstruct the input audio signal 102.

Referring to FIG. 4, a particular illustrative embodiment of a system 400 that is operable to reproduce an audio signal using a mixing factor ($\alpha$) is shown. The system 400 includes a non-linear transformation generator 407, an envelope tracker 402, a noise combiner 440, a first combiner 454, a second combiner 456, a subtractor 452, and a mixer 411. In a particular embodiment, the system 400 may be integrated into a decoding system or apparatus (e.g., in a wireless telephone or CODEC). In other particular embodiments, the system 400 may be integrated into a set top box, a music player, a video player, an entertainment unit, a navigation device, a communications device, a PDA, a fixed location data unit, or a computer.

The non-linear transformation generator 407 may be configured to receive the low-band excitation signal 144 of FIG. 1. For example, the low-band bit stream 142 of FIG. 1 may include the low-band excitation signal 144, and may be transmitted to the system 400 as the bit stream 192. The non-linear transformation generator 407 may be configured to generate a second harmonically extended signal 408 based on the low-band excitation signal 144. For example, the non-linear transformation generator 407 may perform an absolute-value operation or a square operation on frames of the low-band excitation signal 144 to generate the second harmonically extended signal 408. In a particular embodiment, the non-linear transformation generator 407 may operate in a substantially similar manner as the non-linear transformation generator 207 of FIG. 2. The second harmonically extended signal 408 may be provided to the envelope tracker 402 and to the first combiner 454.

The envelope tracker 402 may be configured to receive the second harmonically extended signal 408 and to calculate a second low-band time-domain envelope 403 corresponding to the second harmonically extended signal 408. For example, the envelope tracker 402 may be configured to calculate the square of each sample of a frame of the second harmonically extended signal 408 to produce a sequence of squared values. The envelope tracker 402 may be configured to perform a smoothing operation on the sequence of squared values, such as by applying a first order IIR low-pass filter to the sequence of squared values. The envelope tracker 402 may be configured to apply a square root function to each sample of the smoothed sequence to produce the second low-band time-domain envelope 403. In a particular embodiment, the envelope tracker 402 may operate in a substantially similar manner as the envelope tracker 202 of FIG. 2. The second low-band time-domain envelope 403 may be provided to the noise combiner 440.

The noise combiner 440 may be configured to combine the second low-band time-domain envelope 403 with white noise 405 generated by a white noise generator (not shown) to produce a second modulated noise signal 420. For example, the noise combiner 440 may be configured to amplitude-modulate the white noise 405 according to the second low-band time-domain envelope 403. In a particular embodiment, the noise combiner 440 may be implemented as a multiplier that is configured to scale the output of the white noise 405 according to the second low-band time-domain envelope 403 to produce the second modulated noise signal 420. In a particular embodiment, the noise combiner 440 may operate in a substantially similar manner as the noise combiner 240 of FIG. 2. The second modulated noise signal 420 may be provided to the second combiner 456.

The mixing factor ($\alpha$) of FIG. 2 may be provided to the first combiner 454 and to the subtractor 452. For example, the high-band side information 172 of FIG. 1 may include the mixing factor ($\alpha$) and may be transmitted to the system 400. The subtractor 452 may subtract the mixing factor ($\alpha$) from one and provide the difference ($1-\alpha$) to the second combiner 256. The first combiner 454 may be implemented as a multiplier that is configured to scale the second harmonically extended signal 408 according to the mixing factor ($\alpha$) to generate a first scaled signal. The second combiner 454 may be implemented as a multiplier that is configured to scale the modulated noise signal 420 based on the factor ($1-\alpha$) to generate a second scaled signal. For example, the second combiner 454 may scale the modulated noise signal 420 based on the difference ($1-\alpha$) generated at the subtractor 452. The first scaled signal and the second scaled signal may be provided to the mixer 411.

The mixer 411 may generate a second high-band excitation signal 461 based on the mixing factor ($\alpha$), the second harmonically extended signal 408, and the second modulated noise signal 420. For example, the mixer 411 may combine (e.g., add) the first scaled signal and the second scaled signal to generate the second high-band excitation signal 461.

The system 400 of FIG. 4 may reproduce the high-band signal 124 of FIG. 1 using the second high-band excitation signal 461. For example, the system 400 may produce a second high-band excitation signal 461 that is substantially similar to the high-band excitation signal 161 of FIGS. 1-2 by receiving the mixing factor ($\alpha$) via the high-band side information 172. The second high-band excitation signal 461 may undergo a linear prediction coefficient synthesis operation to generate a high-band signal that is substantially similar to the high-band signal 124.

Referring to FIG. 5, flowcharts to illustrate particular embodiments of methods 500, 510 for reproducing a high-band signal using a mixing factor ($\alpha$) are shown. The first method 500 may be performed by the systems 100-300 of FIG. 3. The second method 510 may be performed by the system 400 of FIG. 4.

The first method 500 may include generating a high-band residual signal based on a high-band portion of an audio signal, at 502. For example, in FIG. 2, the linear prediction analysis filter 204 may generate the high-band residual signal 224 based on the high-band signal 124 (e.g., a high-band portion of the input audio signal 102). In a particular embodiment, the linear prediction analysis filter 204 may encode the spectral envelope of the high-band signal 124 as a set of LPCs used to predict future samples of the high-band signal 124. The high-band residual signal 224 may be used to predict the error of the high-band excitation signal 161.

A harmonically extended signal may be generated at least based on a low-band portion of the audio signal, at 504. For example, the low-band excitation signal 144 of FIG. 1 may be generated from the low-band signal 122 (e.g., the low-band portion of the input audio signal 102) using the low-band analysis module 130. The non-linear transformation generator 207 of FIG. 2 may perform an absolute-value operation or a square operation on the low-band excitation signal 144 to generate the harmonically extended signal 208.

A mixing factor may be determined based on the high-band residual signal, the harmonically extended signal, and modulated noise, at 506. For example, the mixing factor calculator 212 of FIG. 2 may determine the mixing factor ($\alpha$) based on a mean square error (E) of a difference between the high-band residual signal 224 and the high-band excitation signal 161. Using the closed-loop analysis, the high-band excitation signal 161 may be approximately equal to the high-band residual signal 224 to effectively minimize the mean square error (E) (e.g., set the mean square error (E) to zero). As explained with respect to FIG. 2, the mixing factor ($\alpha$) may be expressed as:

$$\alpha=[(R_{HB}-\hat{W}_{MOD})*(\hat{R}_{LB}-\hat{W}_{MOD})]/(\hat{R}_{LB}-\hat{W}_{MOD})^2. \quad \text{(Equation 5)}$$

The mixing factor (α) may be transmitted to a speech decoder. For example, the high-band side information 172 of FIG. 1 may include the mixing factor (α).

The second method 510 may include receiving, at a speech decoder, an encoded signal including low-band excitation signal and high-band side information, at 512. For example, the non-linear transformation generator 407 of FIG. 4 may receive the low-band excitation signal 144 of FIG. 1. The low-band bit stream 142 of FIG. 1 may include the low-band excitation signal 144, and may be transmitted to the system 400 as the bit stream 192. The first combiner 454 and the subtractor 452 may receive the high-band side information 172. The high-band side information 172 may include the mixing factor (α) determined based on the high-band residual signal 224, the harmonically extended signal 208, and the modulated noise signal 220.

High-band excitation signal may be generated based on the high-band side information and the low-band excitation signal, at 514. For example, the mixer 411 of FIG. 4 may generate the second high-band excitation signal 461 based on the mixing factor (α), the second harmonically extended signal 408, and the modulated noise signal 420.

The methods 500, 510 of FIG. 5 may estimate the mixing factor (α) (e.g., using a closed-loop analysis) to improve accuracy of a high-band estimate during high-band prediction and may use the mixing factor (α) to reconstruct the high-band signal 124. For example, the mixing factor calculator 212 may estimate a mixing factor (α) that would produce a high-band excitation signal 161 that is approximately equivalent to the high-band residual signal 224. Thus, in scenarios where increased noise reduces a correlation between the low-band and the high-band, the method 500 may predict the high-band using characteristics (e.g., the high-band residual signal 224) of the high-band. Transmitting the mixing factor (α) to the receiver along with the other high-band side information 172 may enable the receiver to perform reverse operations to reconstruct the input audio signal 102. For example, the second high-band excitation signal 461 may be produced that is substantially similar to the high-band excitation signal 161 of FIGS. 1-2. The second high-band excitation signal 461 may undergo a linear prediction coefficient synthesis operation to generate a synthesized high-band signal that is substantially similar to the high-band signal 124.

In particular embodiments, the methods 500, 510 of FIG. 5 may be implemented via hardware (e.g., a FPGA device, an ASIC, etc.) of a processing unit, such as a central processing unit (CPU), a DSP, or a controller, via a firmware device, or any combination thereof. As an example, the method 500, 510 of FIG. 5 can be performed by a processor that executes instructions, as described with respect to FIG. 6.

Referring to FIG. 6, a block diagram of a particular illustrative embodiment of a wireless communication device is depicted and generally designated 600. The device 600 includes a processor 610 (e.g., a central processing unit (CPU)) coupled to a memory 632. The memory 632 may include instructions 660 executable by the processor 610 and/or a CODEC 634 to perform methods and processes disclosed herein, such as the methods 500, 510 of FIG. 5.

In a particular embodiment, the CODEC 634 may include a mixing factor estimation system 682 and a decoding system 684 according to an estimated mixing factor. In a particular embodiment, the mixing factor estimation system 682 includes one or more components of the mixing factor calculator 162 of FIG. 1, one or more components of the system 200 of FIG. 2, and/or one or more components of the system 300 of FIG. 3. For example, the mixing factor estimation system 682 may perform encoding operations associated with the system 100-300 of FIGS. 1-3 and the method 500 of FIG. 5. In a particular embodiment, the decoding system 684 may include one or more components of the system 400 of FIG. 4. For example, the decoding system 684 may perform decoding operations associated with the system 400 of FIG. 4 and the method 510 of FIG. 5. The mixing factor estimation system 682 and/or the decoding system 684 may be implemented via dedicated hardware (e.g., circuitry), by a processor executing instructions to perform one or more tasks, or a combination thereof.

As an example, the memory 632 or a memory 690 in the CODEC 634 may be a memory device, such as a random access memory (RAM), magnetoresistive random access memory (MRAM), spin-torque transfer MRAM (STT-MRAM), flash memory, read-only memory (ROM), programmable read-only memory (PROM), erasable programmable read-only memory (EPROM), electrically erasable programmable read-only memory (EEPROM), registers, hard disk, a removable disk, or a compact disc read-only memory (CD-ROM). The memory device may include instructions (e.g., the instructions 660 or the instructions 695) that, when executed by a computer (e.g., a processor in the CODEC 634 and/or the processor 610), may cause the computer to perform at least a portion of one of the methods 500, 510 of FIG. 5. As an example, the memory 632 or the memory 690 in the CODEC 634 may be a non-transitory computer-readable medium that includes instructions (e.g., the instructions 660 or the instructions 695, respectively) that, when executed by a computer (e.g., a processor in the CODEC 634 and/or the processor 610), cause the computer perform at least a portion of one of the methods 500, 510 of FIG. 5.

The device 600 may also include a DSP 696 coupled to the CODEC 634 and to the processor 610. In a particular embodiment, the DSP 696 may include a mixing factor estimation system 697 and a decoding system 698 according to an estimated mixing factor. In a particular embodiment, the mixing factor estimation system 697 includes one or more components of the mixing factor calculator 162 of FIG. 1, one or more components of the system 200 of FIG. 2, and/or one or more components of the system 300 of FIG. 3. For example, the mixing factor estimation system 697 may perform encoding operations associated with the system 100-300 of FIGS. 1-3 and the method 500 of FIG. 5. In a particular embodiment, the decoding system 698 may include one or more components of the system 400 of FIG. 4. For example, the decoding system 698 may perform decoding operations associated with the system 400 of FIG. 4 and the method 510 of FIG. 5. The mixing factor estimation system 697 and/or the decoding system 698 may be implemented via dedicated hardware (e.g., circuitry), by a processor executing instructions to perform one or more tasks, or a combination thereof.

FIG. 6 also shows a display controller 626 that is coupled to the processor 610 and to a display 628. The CODEC 634 may be coupled to the processor 610, as shown. A speaker 636 and a microphone 638 can be coupled to the CODEC 634. For example, the microphone 638 may generate the input audio signal 102 of FIG. 1, and the CODEC 634 may generate the output bit stream 192 for transmission to a receiver based on the input audio signal 102. As another example, the speaker 636 may be used to output a signal reconstructed by the CODEC 634 from the output bit stream 192 of FIG. 1, where the output bit stream 192 is received from a transmitter. FIG. 6 also indicates that a wireless controller 640 can be coupled to the processor 610 and to a wireless antenna 642.

In a particular embodiment, the processor 610, the display controller 626, the memory 632, the CODEC 634, and the wireless controller 640 are included in a system-in-package or system-on-chip device (e.g., a mobile station modem (MSM)) 622. In a particular embodiment, an input device 630, such as a touchscreen and/or keypad, and a power supply 644 are coupled to the system-on-chip device 622. Moreover, in a particular embodiment, as illustrated in FIG. 6, the display 628, the input device 630, the speaker 636, the microphone 638, the wireless antenna 642, and the power supply 644 are external to the system-on-chip device 622. However, each of the display 628, the input device 630, the speaker 636, the microphone 638, the wireless antenna 642, and the power supply 644 can be coupled to a component of the system-on-chip device 622, such as an interface or a controller.

In conjunction with the described embodiments, a first apparatus is disclosed that includes means for generating a high-band residual signal based on a high-band portion of an audio signal. For example, the means for generating the high-band residual signal may include the analysis filter bank 110 of FIG. 1, the LP analysis and coding module 152 of FIG. 1, the linear prediction analysis filter 204 of FIGS. 2-3, the mixing factor estimation system 682 of FIG. 6, the CODEC 634 of FIG. 6, the mixing factor estimation system 697 of FIG. 6, the DSP 696 of FIG. 6, or any combination thereof.

The first apparatus may also include means for generating a harmonically extended signal at least partially based on a low-band portion of the audio signal. For example, the means for generating the harmonically extended signal may include the analysis filter bank 110 of FIG. 1, the low-band analysis filter 130 of FIG. 1 or a component thereof, the non-linear transformation generator 207 of FIGS. 2-3, the mixing factor estimation system 682 of FIG. 6, the mixing factor estimation system 697 of FIG. 6, the DSP 696 of FIG. 6, or any combination thereof.

The first apparatus also includes means for determining a mixing factor based on the high-band residual signal, the harmonically extended signal, and modulated noise. For example, the means for determining the mixing factor may include the high-band excitation generator 160 of FIG. 1, the mixing factor calculator 162 of FIG. 1, the mixing factor calculator 212 of FIG. 2, the error detection circuit 306 of FIG. 3, the error minimization calculator 308 of FIG. 3, the high-band excitation generator 302 of FIG. 3, the mixing factor estimation system 682 of FIG. 6, the CODEC 634 of FIG. 6, the mixing factor estimation system 697 of FIG. 6, the DSP 696 of FIG. 6, or any combination thereof.

In conjunction with the described embodiments, a second apparatus includes means for receiving an encoded signal including a low-band excitation signal and high-band side information. The high-band side information includes a mixing factor determined based on a high-band residual signal, a harmonically extended signal, and modulated noise. For example, the means for receiving the encoded signal may include the non-linear transformation generator 407 of FIG. 4, the first combiner 454 of FIG. 4, the subtractor 452 of FIG. 4, CODEC 634 of FIG. 6, the decoding system 684 of FIG. 6, the decoding system 698 of FIG. 6, the DSP 696 of FIG. 6, or any combination thereof.

The second apparatus may also include means for generating a high-band excitation signal based on the high-band side information and the low-band excitation signal. For example, the means for generating the high-band excitation signal may include the non-linear transformation generator 407 of FIG. 4, the envelope tracker 402 of FIG. 4, the noise combiner 440 of FIG. 4, the first combiner 454 of FIG. 4, the second combiner 456 of FIG. 4, the subtractor 452 of FIG. 4, the mixer 411 of FIG. 4, the CODEC 634 of FIG. 6, the decoding system 684 of FIG. 6, the decoding system 698 of FIG. 6, the DSP 696 of FIG. 6, or any combination thereof.

Those of skill would further appreciate that the various illustrative logical blocks, configurations, modules, circuits, and algorithm steps described in connection with the embodiments disclosed herein may be implemented as electronic hardware, computer software executed by a processing device such as a hardware processor, or combinations of both. Various illustrative components, blocks, configurations, modules, circuits, and steps have been described above generally in terms of their functionality. Whether such functionality is implemented as hardware or executable software depends upon the particular application and design constraints imposed on the overall system. Skilled artisans may implement the described functionality in varying ways for each particular application, but such implementation decisions should not be interpreted as causing a departure from the scope of the present disclosure.

The steps of a method or algorithm described in connection with the embodiments disclosed herein may be embodied directly in hardware, in a software module executed by a processor, or in a combination of the two. A software module may reside in a memory device, such as random access memory (RAM), magnetoresistive random access memory (MRAM), spin-torque transfer MRAM (STT-MRAM), flash memory, read-only memory (ROM), programmable read-only memory (PROM), erasable programmable read-only memory (EPROM), electrically erasable programmable read-only memory (EEPROM), registers, hard disk, a removable disk, or a compact disc read-only memory (CD-ROM). An exemplary memory device is coupled to the processor such that the processor can read information from, and write information to, the memory device. In the alternative, the memory device may be integral to the processor. The processor and the storage medium may reside in an ASIC. The ASIC may reside in a computing device or a user terminal. In the alternative, the processor and the storage medium may reside as discrete components in a computing device or a user terminal.

The previous description of the disclosed embodiments is provided to enable a person skilled in the art to make or use the disclosed embodiments. Various modifications to these embodiments will be readily apparent to those skilled in the art, and the principles defined herein may be applied to other embodiments without departing from the scope of the disclosure. Thus, the present disclosure is not intended to be limited to the embodiments shown herein but is to be accorded the widest scope possible consistent with the principles and novel features as defined by the following claims.

What is claimed is:

1. A method of adjusting a mixing parameter to reduce artifacts associated with a high-band estimate, the method comprising:

generating, at a speech encoder, a high-band residual signal based on a high-band portion of an audio signal;

generating a harmonically extended signal at least partially based on a low-band portion of the audio signal;

estimating a high-band adjustment factor using a closed-loop analysis, the high-band adjustment factor estimated based on the high-band residual signal, the harmonically extended signal, and modulated noise, wherein the modulated noise is at least partially based on the harmonically extended signal and white noise;

estimating a mixing factor based on the high-band adjustment factor and a voicing factor;

scaling the harmonically extended signal based on the mixing factor to generate a first scaled signal;

scaling the modulated noise based on the mixing factor to generate a second scaled signal;

combining the first scaled signal and the second scaled signal to generate a high-band excitation signal;

generating an encoded bit-stream corresponding to an encoded version of the audio signal, the encoded bit-stream including data representing the high-band adjustment factor; and transmitting the encoded bit-stream to a receiver, the encoded bit-stream usable by the receiver to reconstruct the audio signal.

2. The method of claim 1, wherein estimating the high-band adjustment factor using the closed-loop analysis comprises:

comparing the high-band residual signal to the high-band excitation signal;

generating an error signal based on the comparison; and adjusting the high-band adjustment factor based on the error signal.

3. The method of claim 2, wherein the error signal is based on a difference of temporal characteristics of the high-band excitation signal and temporal characteristics of the high-band residual signal.

4. The method of claim 1, wherein the mixing factor is further estimated at least based on low band voicing, low band tilt, or any combination thereof.

5. The method of claim 1, further comprising:

selectively incrementing or decrementing a first high-band adjustment factor to generate a second high-band adjustment factor, wherein the high-band adjustment factor corresponds to the first high-band adjustment factor in response to a determination that a mean square error based on the first high-band adjustment factor is less than a mean square error based on the second high-band adjustment factor, and wherein the high-band adjustment factor corresponds to the second high-band adjustment factor in response to a determination that the mean square error based on the second high-band adjustment factor is less than the mean square error based on the first high-band adjustment factor.

6. The method of claim 1, further comprising:

performing a linear predication analysis on the high-band portion of the audio signal to generate the high-band residual signal;

performing a linear prediction analysis on the low-band portion of the audio signal to generate a low-band residual signal;

quantizing the low-band residual signal to generate a low-band excitation signal; and performing a non-linear filtering operation on the low-band excitation signal to generate the harmonically extended signal.

7. An apparatus for adjusting a mixing parameter to reduce artifacts associated with a high-band estimate, the apparatus comprising:

a linear prediction analysis filter configured to generate a high-band residual signal based on a high-band portion of an audio signal;

a non-linear transformation generator configured to generate a harmonically extended signal at least partially based on a low-band portion of the audio signal;

a high-band adjustment factor calculator configured to estimate a high-band adjustment factor using a closed-loop analysis, the high-band adjustment factor estimated based on the high-band residual signal, the harmonically extended signal, and modulated noise, wherein the modulated noise is at least partially based on the harmonically extended signal and white noise;

a mixing factor calculator configured to estimate a mixing factor based on the high-band adjustment factor and a voicing factor;

a high-band excitation generator configured to:

scale the harmonically extended signal based on the mixing factor to generate a first scaled signal;

scale the modulated noise based on the mixing factor to generate a second scaled signal; and combine the first scaled signal and the second scaled signal to generate a high-band excitation signal;

encoding circuitry configured to generate an encoded bit-stream corresponding to an encoded version of the audio signal, the encoded bit-stream including data representing the high-band adjustment factor; and a transmitter configured to transmit the encoded bit-stream to a receiver, the encoded bit-stream usable by the receiver to reconstruct the audio signal.

8. The apparatus of claim 7, further comprising an error detection circuit and an error minimization calculator to estimate the high-band adjustment factor using the closed-loop analysis;

wherein the error detection circuit is configured to compare the high-band residual signal to the high-band excitation signal; and wherein the error minimization calculator is configured to:

generate an error signal based on the comparison; and adjust the high-band adjustment factor based on the error signal.

9. The apparatus of claim 8, wherein the error signal is based on a difference of temporal characteristics of the high-band excitation signal and temporal characteristics of the high-band residual signal.

10. The apparatus of claim 7, wherein the mixing factor calculator is further configured to estimate the mixing factor at least based on low band voicing, low band tilt, or any combination thereof.

11. The apparatus of claim 7, further comprising an error controller configured to:

selectively increment or decrement a first high-band adjustment factor to generate a second high-band adjustment factor, wherein the high-band adjustment factor corresponds to the first high-band adjustment factor in response to a determination that a mean square error based on the first high-band adjustment factor is less than a mean square error based on the second high-band adjustment factor, and wherein the high-band adjustment factor corresponds to the second high-band adjustment factor in response to a determination that the mean square error based on the second high-band adjustment factor is less than the mean square error based on the first high-band adjustment factor.

12. The apparatus of claim 7, wherein the linear prediction analysis filter is configured to perform a first linear prediction analysis on the high-band portion of the audio signal to generate the high-band residual signal, and further comprising:

a second linear prediction analysis filter configured to perform a second linear prediction analysis on the low-band portion of the audio signal to generate a low-band residual signal; and a quantizer configured to quantize the low-band residual signal to generate a low-band excitation signal, wherein the non-linear transformation generator is configured to perform a non-linear filtering operation on the low-band excitation signal to generate the harmonically extended signal.

13. A non-transitory computer readable medium comprising instructions for adjusting a mixing parameter to reduce artifacts associated with a high-band estimate, the instructions, when executed by a processor at a speech encoder, cause the processor to perform operations comprising:

generating a high-band residual signal based on a high-band portion of an audio signal;

generating a harmonically extended signal at least partially based on a low-band portion of the audio signal;

estimating a high-band adjustment factor using a closed-loop analysis, the high-band adjustment factor estimated based on the high-band residual signal, the harmonically extended signal, and modulated noise, wherein the modulated noise is at least partially based on the harmonically extended signal and white noise;

estimating a mixing factor based on the high-band adjustment factor and a voicing factor;

scaling the harmonically extended signal based on the mixing factor to generate a first scaled signal;

scaling the modulated noise based on the mixing factor to generate a second scaled signal;

combining the first scaled signal and the second scaled signal to generate the high-band excitation signal;

generating an encoded bit-stream corresponding to an encoded version of the audio signal, the encoded bit-stream including data representing the high-band adjustment factor; and initiating transmission of the encoded bit-stream to a receiver, the encoded bit-stream usable by the receiver to reconstruct the audio signal.

14. The non-transitory computer readable medium of claim 13, wherein estimating the high-band adjustment factor using the closed-loop analysis comprises:

comparing the high-band residual signal to the high-band excitation signal;

generating an error signal based on the comparison; and adjusting the high-band adjustment factor based on the error signal.

15. The non-transitory computer readable medium of claim 14, wherein the error signal is based on a difference of temporal characteristics of the high-band excitation signal and temporal characteristics of the high-band residual signal.

16. An apparatus for adjusting a mixing parameter to reduce artifacts associated with a high-band estimate, the apparatus comprising:

means for generating a high-band residual signal based on a high-band portion of an audio signal;

means for generating a harmonically extended signal at least partially based on a low-band portion of the audio signal;

means for estimating a high-band adjustment factor using a closed-loop analysis, the high-band adjustment factor estimated based on the high-band residual signal, the harmonically extended signal, and modulated noise, wherein the modulated noise is at least partially based on the harmonically extended signal and white noise;

means for estimating a mixing factor based on the high-band adjustment factor and a voicing factor;

means for generating a high-band excitation signal, the means for generating the high-band excitation signal comprising:

means for scaling the harmonically extended signal based on the mixing factor to generate a first scaled signal;

means for scaling the modulated noise based on the mixing factor to generate a second scaled signal; and mean for combining the first scaled signal and the second scaled signal to generate the high-band excitation signal;

means for generating an encoded bit-stream corresponding to an encoded version of the audio signal, the encoded bit-stream including data representing the high-band adjustment factor; and means for transmitting the encoded bit-stream to a receiver, the encoded bit-stream usable by the receiver to reconstruct the audio signal.

17. The apparatus of claim 16, wherein estimating the high-band adjustment factor using the closed-loop analysis comprises:

comparing the high-band residual signal to the high-band excitation signal, wherein the high-band excitation signal is generated based on the high-band adjustment factor, the harmonically extended signal, and the modulated noise;

generating an error signal based on the comparison; and adjusting the high-band adjustment factor based on the error signal.

18. The apparatus of claim 17, wherein the error signal is based on a difference of temporal characteristics of the high-band excitation signal and temporal characteristics of the high-band residual signal.

* * * * *